United States Patent [19]

Buhrer

[11] 4,399,392

[45] Aug. 16, 1983

[54] ARC LAMP POWER SUPPLY

[75] Inventor: Carl F. Buhrer, Framingham, Mass.

[73] Assignee: GTE Laboratories Incorporated, Waltham, Mass.

[21] Appl. No.: 352,675

[22] Filed: Feb. 26, 1982

[51] Int. Cl.[3] ..... G05F 1/00; H05B 39/00

[52] U.S. Cl. ..... 315/308; 315/47; 315/92; 315/209 R

[58] Field of Search ..... 315/92, 307, 308, 209 R, 315/47

[56] References Cited

U.S. PATENT DOCUMENTS

| | | | |
|---|---|---|---|
| 3,517,254 | 6/1970 | McNamara | 315/91 |
| 3,737,720 | 6/1973 | Willis | 315/92 |
| 3,873,882 | 3/1975 | Gershen | 315/92 |
| 4,005,331 | 1/1977 | Horowitz | 315/92 |
| 4,047,076 | 9/1977 | McNamara | 315/92 |
| 4,091,307 | 5/1978 | McNamara | 315/92 |
| 4,151,445 | 4/1979 | Davenport | 315/92 |
| 4,170,744 | 10/1979 | Hansler | 315/90 |
| 4,278,916 | 7/1981 | Regan | 315/92 |
| 4,350,930 | 9/1982 | Peil et al. | 315/92 |

*Primary Examiner*—Harold A. Dixon

*Attorney, Agent, or Firm*—J. Stephen Yeo; Charles A. Doctycz

[57] ABSTRACT

An electric arc lamp in combination with an electronically controlled incandescent filament to provide auxiliary illumination during warm-up and hot restart of the arc lamp, the filament control circuit being responsive to the arc lamp voltage and current and operative in three modes, full off, full on, and switching on and off the latter so as to allow capacitive and inductive coupling of energy into the arc lamp for the purpose of starting it and bringing it into the arc mode of operation.

7 Claims, 3 Drawing Figures

ARC LAMP POWER SUPPLY

CROSS REFERENCE TO RELATED APPLICATIONS

The present invention is related to copending U.S. patent application Ser. No. 332,065, filed on Dec. 18, 1981 for a "Ballast Circuit for Direct Current Arc Lamp", assigned to the same assignee.

BACKGROUND OF THE INVENTION (1) Field of the Invention

This invention relates generally to an instant lighting lamp combining a miniature arc tube with a standby filament and is more particularly concerned with a ballasting arrangement to permit such a lamp to be used as a replacement for a conventional incandescent lamp.

(2) Description of the Prior Art

Electric arc lamps, such as the high pressure mercury vapor lamp or the metal iodide arc lamp related to it, are far more efficient light sources than the commonly used incandescent filament lamp. They have long been used for street lighting and in industrial applications. They have not been used at all in the home where most fixtures and lamps are designed to accommodate screw-in type incandescent lamps. Adapting these arc lamps, particularly in their smaller sizes, as direct replacements for incandescent lamps has become a serious energy saving goal.

The obstacle to be overcome in replacing the screw-in incandescent lamp with a small arc lamp is the ballasting circuit required to regulate the arc current being drawn from the fixed voltage AC power line. This circuit must be small and lightweight so that it can be integral to the light source package, and moreover, it must be simple and inexpensive so that the replacement lamp is affordable to the consumer. Most important, it should be energy-efficient so that the high efficiency of the arc lamp is not degraded by losses in the ballasting circuit.

As a replacement for an incandescent lamp in the home, two other peculiarities of the arc lamp must be overcome to make the new device an acceptable light source. One is the slow arc warm-up during which time the light intensity only gradually increases, the other is the inability to hot restart, which means that a momentary shut-off of the arc by a power line interruption requires the lamp to first cool down, restart and then warm up again, during which time it does not produce much light. To remedy this unacceptable behavior, an auxiliary incandescent filament is included in the same glass jacket that encloses the small quartz arc tube. It produces light immediately upon turn-on while the arc lamp is warming up, and also comes on during any hot restart cycle so that there is always some light output produced. However, during normal operation, this incandescent filament should be totally shut off for energy efficiency.

Prior art ballast circuits have been designed to power a small direct current metal halide lamp. This lamp nominally contains a fill consisting of mercury, iodides of sodium and scandium, and argon gas. It requires a starting potential of several hundreds of volts to initiate ionization, a few seconds of operation at about 200 V and a few tens of milliamperes to transfer from a glow to an arc discharge and full current for about a minute warm-up, during which time its potential drop rises from about 20 to 80 V. Such DC arc lamps are most simply operated in series with the auxiliary incandescent filament from a DC source obtained by rectifying and filtering the AC power line. In this way, the filament serves as a ballast and produces light during the AC warm-up. Separate circuitry must be used to turn on the filament during cool-down in a hot restart cycle. With this simple circuit, the voltage across the filament is equal to the difference between the rectifier output and the arc lamp voltage, and this difference decreases as the arc lamp warms up. After warm-up, little light is produced by the auxiliary filament, but current continues to flow through it, and its power dissipation is a significant source of inefficiency in this circuit.

SUMMARY OF THE INVENTION

It is an object of this invention to provide an energy-efficient means to ballasting the arc lamp after warm-up, such that during normal operation the high luminous efficiency of the arc can be exploited. It is a further object of this invention to provide a control means for starting the arc lamp by electronic voltage pulsing and for operating the auxiliary incandescent filament only during the warm-up and the hot restart cycles when the additional light output is desirable. It is a still further object of this invention to make multiple uses of several of the circuit components to achieve all of the above operative features with the fewest components and at the lowest feasible cost.

Briefly, there is described a combination of an arc lamp, an auxiliary incandescent filament and a power supply. The power supply senses arc lamp voltage and current and controls filament current accordingly. The power supply provides filament current when arc lamp voltage is high and arc lamp current low, or when arc lamp voltage is low and arc lamp current high. When both arc lamp voltage and current are high, the arc lamp is considered to be in its normal operating mode and current is no longer supplied to the filament. The power supply also provides starting voltage pulses to the arc lamp under high voltage, low current conditions. The pulses may be coupled to a switching current regulator which is in series with the arc lamp. High arc lamp voltage may be considered a voltage of 60 V or more. High arc lamp current may be considered a current of 0.1 amp or more.

The preferred embodiment of the invention includes a thyristor which is gated in accordance with the arc lamp's voltage and current conditions.

DESCRIPTION OF THE PREFERRED EMBODIMENT

Figure 1:
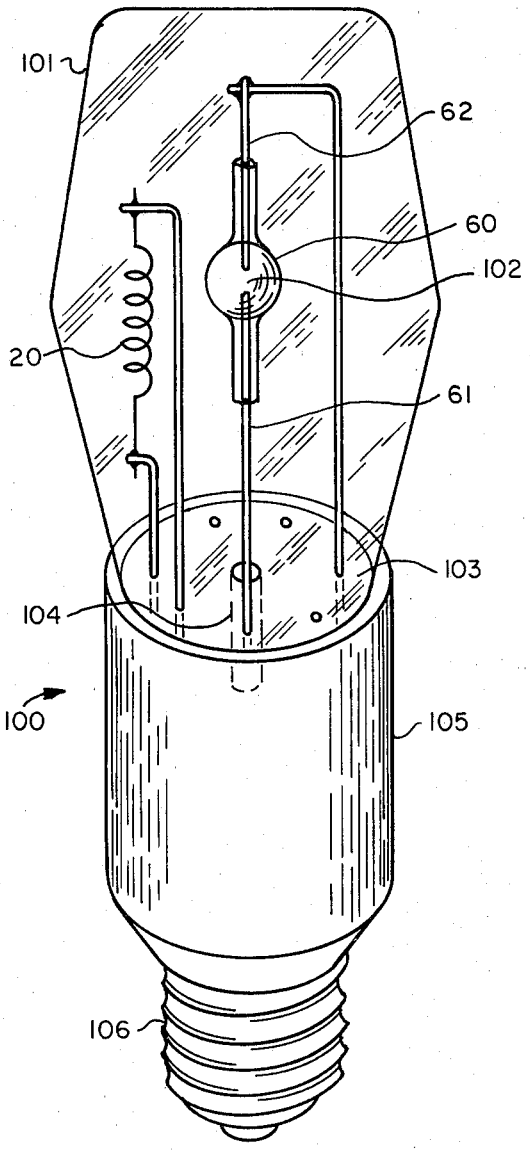
FIG. 1 of the drawings shows in side elevation a combination discharge-incandescent lamp embodying the invention.

FIG. 1 shows a composite light source assembly 100, including a glass envelope 101 containing a quartz arc tube 60, having a top cathode electrode 62, lower anode electrode 61, and fill materials 102. Also within the envelope is auxiliary incandescent filament 20. Leads for all of the components are brought out through a pressed glass header and the envelope 101 is evacuated through exhaust tube 104.

Below the glass envelope 101 of the light source assembly 100 is an enclosure 105 housing the electronic components constituting the ballast circuit shown in FIG. 2. A screw base 106 allows the assembly 100 to replace directly a screw-in incandescent lamp.

Figure 2:
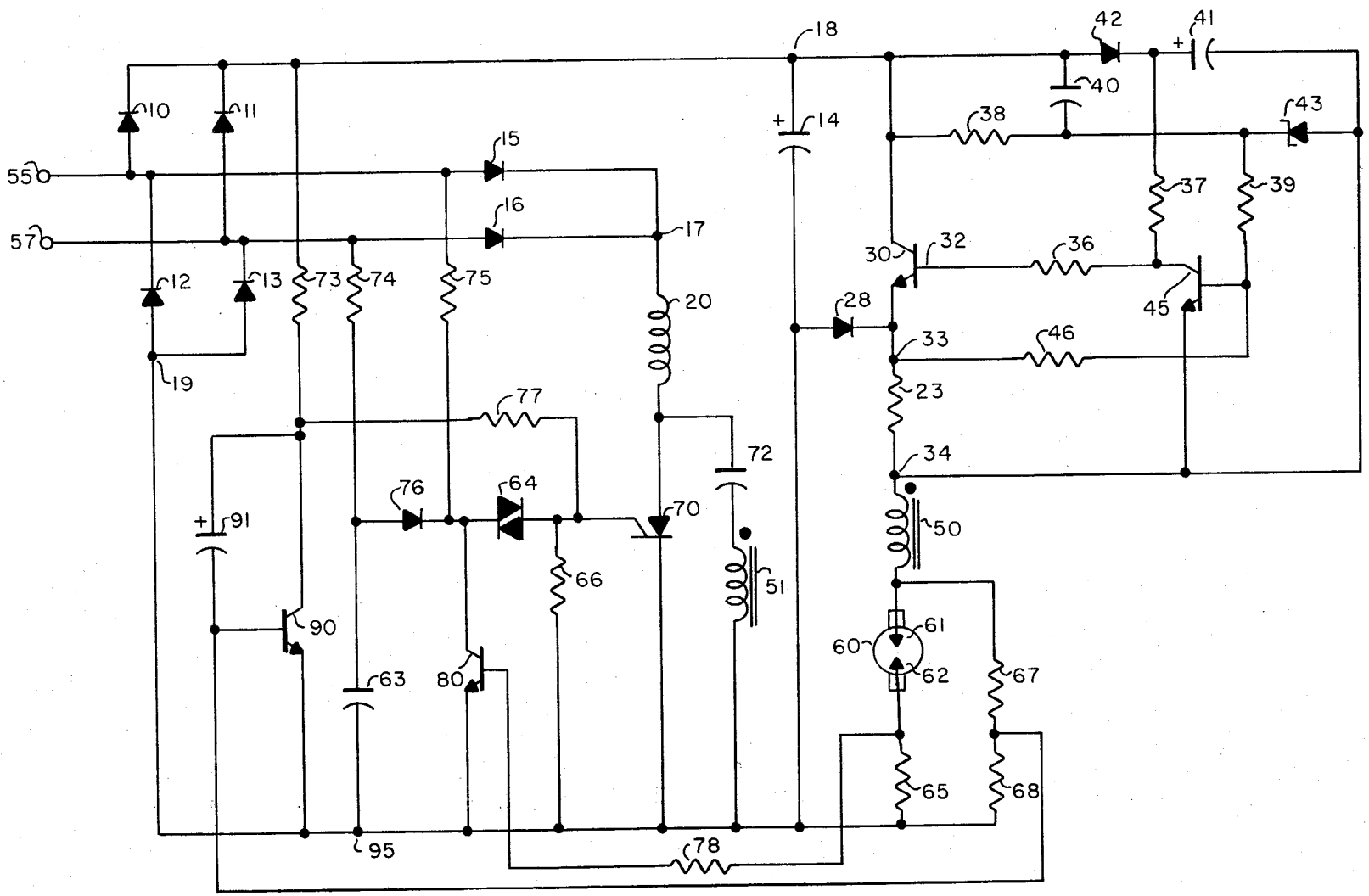
FIG. 2 is a circuit diagram of the preferred embodiment of the invention.

The electronic ballast circuit of the present invention is shown in FIG. 2 and is connected to arc lamp 60 and incandescent filament 20. The ballast circuit includes rectifiers, a filament control circuit, and a switching current regulator. The switching current regulator is operational only after the arc lamp ignites and will be described last.

As shown, silicon rectifier diodes 10, 11, 12 and 13 are connected in a bridge circuit with the output to an electrolytic type filter capacitor 14. When a 115 V ac power line is connected across input terminals 55 and 57, a rectified and filtered DC voltage of about 165 V is produced between points 18 and 95.

Arc discharge lamp 60 contains an anode electrode 61 and cathode 62. It is connected in series between points 18 and 95 with current sensing resistors 65 and 23 having resistances of a few ohms or less, inductor 50, and switching transistor 30. Transistor 30 is controlled by the driver circuit shown on the right in response to the voltages at points 18, 32, 33, and 34 as will be described later. Resistors 67 and 68 constitute a voltage divider network for sensing the voltage drop across the arc discharge lamp 60.

When power is first applied to the circuit, the rectified voltage across the arc tube rises to the 165 V nominal output from the bridge rectifier, but its current is essentially zero before ignition.

The filament control circuit has the dual purpose of igniting the arc discharge tube, bringing it through the glow-to-arc transition and providing auxiliary illumination by means of incandescent filament 20 while the arc lamp is warming up or while it is going through a hot restart cycle. The appropriate one of the three filament current modes is automatically selected according to the voltage drop across the arc tube, as sensed by the voltage divider comprised of resistors 67 and 68 and the current through the arc tube, as determined by the voltage drop developed across current sensing resistor 65. Diodes 15 and 16, along with diodes 12 and 13, comprise a second rectifier bridge assembly that provides an unfiltered, but full wave rectified direct current voltage between points 17 and 95. Auxiliary incandescent filament 20 and thyristor 70 are connected in series between points 17 and 95. Current through the filament is controlled by thyristor 70, which conducts depending on the nature of the gate current.

A pulsing mode of operation of thyristor 70 takes place during the starting or hot restarting phases of arc lamp operation. Prior to starting the arc lamp current is essentially zero so that transistor 80 is nonconducting, but the voltage across the arc lamp is well above the approximately 60 V level at which transistor 90 conducts and the latter prevents resistor 73 from feeding a steady gate current to thyristor 70.

A relaxation oscillator provides short current pulses at a rate of about 3 kHz to the gate of thyristor 70 which, as will be seen, eventually causes the arc lamp 60 to ignite. During alternate half cycles capacitor 63 is charged through resistor 74 and when its voltage reaches the breakdown potential (normally 32 V) of diac 64, it discharges through the gate of thyristor 70 causing it to conduct a pulse of current as it abruptly discharges capacitor 72 through inductor winding 51 which resonate at a frequency from 10 to 20 kHz.

As the oscillatory current in inductor 51 and capacitor 72 reverses phase, the current through filament 20 is diverted momentarily from thyristor 70 through the resonant circuit, and the thyristor is commuted to the OFF state. During that portion of the switching cycle when thyristor 70 is off, current through filament 20 and diode 16 charges capacitor 72 to about 150 V via inductor 51. Each time thyristor 70 is turned on, capacitor 72 is abruptly discharged through inductor 51 and continues to ring at an oscillatory frequency of from 10 to 20 kHz or several times that of the switching drive. Inductors 50 and 51 consist of two windings on a common laminated iron core. Because of the close magnetic coupling and the high turns ratio of winding 50 to winding 51 on the transformer, a high positive voltage pulse is applied to anode 61 of the arc tube 60. Diode 28 completes the circuit. For a nominal turns ratio of 8:1, a 1200 V pulse is produced when the 150 V on capacitor 72 is discharged. A turns ratio of 10:1 gives a 1500 V pulse. A sequence of these high voltage pulses is applied to arc discharge lamp 60 at a rate of about 3 kHz. Each oscillatory cycle eventually ignites arc discharge tube 60, which then begins to glow. It continues to glow on each succeeding oscillatory transient until it passes from the glow mode, where its voltage drop is high, about 200 V, and its current is low, less than 0.1 amp, to the arc beginning mode, where it begins to receive power through the switching transistor 30.

This starting arrangement is operative for both cold starts and hot restarts. A cold start is fairly rapid but during a hot restart cycle the arc lamp requires several minutes to cool down before the starting pulses can reignite it. During this time some auxiliary illumination is required from the incandescent filament, but during the pulsing mode of thyristor operation, the average current through the filament 20 is too low to produce any light. These conflicting requirements are met by utilizing continuous thyristor conduction on alternate half-cycles of the input power line.

Because of rectifier diodes 12 and 13, input terminals 57 and 55 can never be negative with respect to common point 95. They alternate, in a complementary way, between remaining at zero potential and following the positive half-cycle of the input power line on its successive half-cycles. When terminal 57 is positive with respect to point 95, current flows through resistor 74 to charge capacitor 63 and the relaxation oscillation for lamp starting occurs as described above. When terminal 55 is positive, with respect to point 95, on the next half-cycle of the power line, current flows through resistor 75 and diac 64 continuously into the gate of thyristor 70. Capacitor 63 cannot charge because of the isolation diode 76. The thyristor therefore conducts fully on these alternate half-cycles and allows the auxiliary incandescent filament 20 to produce an adequate level of illumination during start and hot restart cycles. This is the first mode of filament operation.

Upon ignition or reignition the arc lamp enters the initial warm-up stages of the arc mode. The driver circuit is now operational as will be described later. The voltage across the arc lamp is low, dropping well below 60 V to about 20 V. Lamp current is greater than about 0.1 amp and begins to flow through current sensing resistor 65, and through resistor 78 to the base of transistor 80 which conducts, thereby shunting the currents through resistors 74 and 75 to common point 95. The high arc lamp current stops the generation of lamp ignition pulses and the steady conduction of the thyristor on alternate half-cycles of the power line. But, because of the low arc voltage, divided by resistors 67 and 68, transistor 90 turns off, allowing a steady filtered direct current to flow through resistors 73 and 77 to the gate of thyristor 70, and the auxiliary incandescent filament 20 lights at full brilliance as it now conducts current on both half-cycles of the input power line. This is the second mode of filament operation.

As the arc lamp warms up, its voltage drop increases until it is operating in its normal high efficiency mode. During normal lamp operation the arc lamp voltage is above 60 V, causing transistor 90 to become conductive and shunt the gate current supply from resistor 73 to common lead 95. Also during normal lamp operation lamp current is greater than about 0.1 amp. The voltage drop across the arc lamp current sensing resistor 65 is then sufficient to provide enough current through resistor 78 to keep transistor 80 turned on, thereby shunting the two other sources of gate current from resistors 74 and 75 to common lead 95. Thus during normal arc lamp operation, no gate current is applied to thyristor 70, and auxiliary incandescent filament 20 is completely off, this being the third mode of filament operation.

Resistor 66 provides a steady load for the gate control circuitry to prevent gate triggering on small leakage currents. Capacitor 91 acts as an integrating capacitor to average out voltage fluctuations on the voltage sensed across the arc lamp 60.

Figure 3:
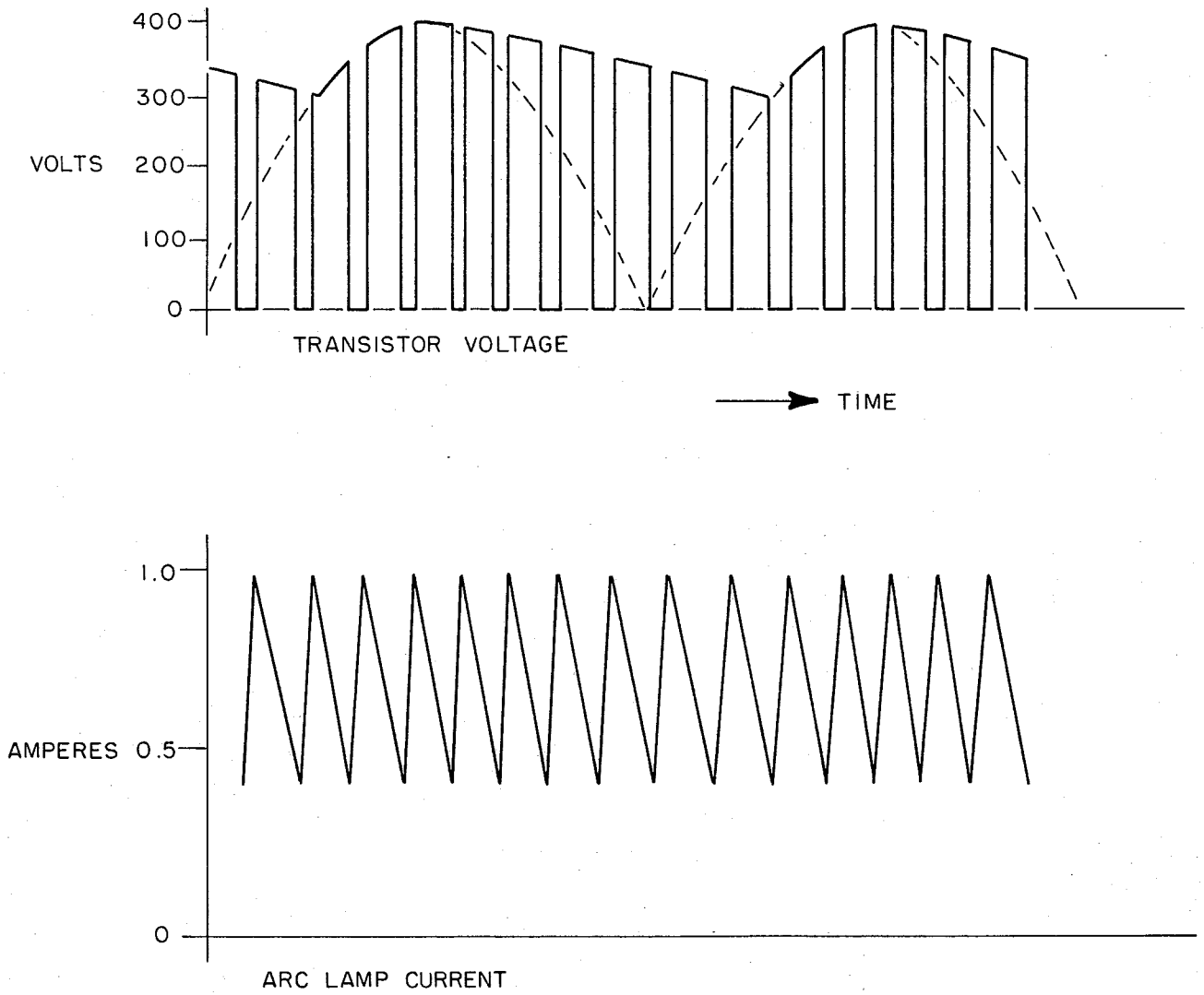
FIG. 3 is a graph illustrating the arc lamp current and the control transistor voltage.

After ignition, the arc lamp is powered by a switching current regulator. The switching current regulator includes a NPN darlington transistor 30, and a driver circuit for switching transistor 30 on and off in response to the magnitude of the current sensed in the form of the voltage drop across resistor 23. When transistor 30 is switched on, current from the rectifier output point 18 flows through it and resistors 23 and 65, inductor 50 and the arc discharge tube 60, increasing in magnitude until a predetermined high limit is reached, as shown in FIG. 3. The driver circuit then switches transistor 30 off and the current decreases, although continuing to flow, but now flows through diode 28, driven by the energy previously stored in inductor 50. When the current through diode 28, resistors 23 and 65, inductor 50 and the discharge tube 60 decrease to a predetermined low limit, the driver circuit again turns on transistor 30 and the oscillatory cycle repeats.

When transistor switch 30 is off, the full DC output voltage of the bridge rectifier appears across points 18 and 34, thereby charging capacitor 41 through diode 42. This charge which is isolated by diode 42 during the on cycle of transistor 30 serves to supply base current drive through resistors 37 and 36 to the base of transistor 30. Transistor 45 shunts this base current to ground, point 34 during those portions of the switching cycle when transistor switch 30 is to be off. Transistor 45 begins conduction when the voltage drop across current sensing resistor 23 reaches the forward base to emitter junction voltage of transistor 45. At that point current begins to flow through resistor 46 into the base of transistor 45. This causes shunting of the base drive to transistor 30 which begins to turn off. The rising voltage at point 18 is coupled through capacitor 40 and resistors 38 and 39, and also to the base of transistor 45, which completely shunts off all of the base drive to transistor 30. The two transistors thereby constitute a bistable flip-flop, which switches transistor 30 between cut-off and saturation. As the flyback current driven through diode 28 and resistor 23 by the energy stored in inductor 50 decreases, the voltage drop across resistor 23 drops to a point where the combined base drive signal of transistor 45 from resistors 46 and 39 no longer exceeds the base to emitter junction drop of transistor 45. At this point transistor 30 again turns on and the switching cycle repeats. Zener diode 43 regulates the feedback voltage applied to resistor 39 from resistor 38 and keeps the current switching levels from being dependent upon the power supply output voltage. This provides an operation at a constant average lamp current over a wide range of line input voltages. Very little power is lost in the current sensing resistors and inductor, and the arc lamp thus operates with a very high efficiency.

While there has been shown and described what is at the present considered the preferred embodiment of the invention, it will be obvious to those skilled in the art that various changes and modifications may be made therein without departing from the scope of the invention as defined by the appended claims.

What is claimed is:

1. The combination of an electric arc lamp, incandescent filament, and power supply, said power supply comprised of:

means for sensing arc lamp voltage;

means for sensing arc lamp current;

means for providing current to said incandescent filament when arc lamp voltage is high and arc lamp current is low, in reference to predetermined values, for providing current to said incandescent filament when arc lamp voltage is low and arc lamp current is high, and for not providing current to said incandescent filament when arc lamp voltage is high and arc lamp current is high;

wherein said means for providing current to said incandescent filament also provides starting voltage pulses to ignite said arc lamp only when arc lamp voltage is high and arc lamp current is low.

2. The combination of claim 1 wherein said power supply further includes a switching current regulator in series with said arc lamp for regulating arc lamp current, after ignition said regulator including an inductor inductively coupled to receive the starting voltage pulses from said means for providing current to said incandescent filament.

3. The combination of claims 1 and 2 wherein said high arc lamp voltage is 60 volts or more said low arc lamp voltage is less than 60 volts said high arc lamp current is 0.1 amp or more and said low arc lamp current is less than 0.1 amp.

4. A combination discharge, incandescent lamp assembly comprising:

(a) a first series circuit including:

(i) an arc lamp; and (ii) current regulating means for regulating arc lamp current and including a first inductor;

(b) means for providing DC voltage across said first series circuit;

(c) means for providing a voltage representing voltage across said arc lamp;

(d) means for providing a voltage representing current flowing through said arc lamp;

(e) a second series circuit including;

(i) a thyristor having a gate, a cathode, and an anode;

(ii) a first capacitor; and (iii) a second inductor in series with said first capacitor, said second inductor and said first capacitor in parallel with the anode and cathode of said thyristor, said second inductor coupled to said first inductor;

(f) means for providing unfiltered full wave rectified voltage across said second series circuit; and (g) gating means for applying gating currents to said gate in response to said voltages representing arc lamp current and voltage, said gating means including an oscillator for applying current pulses to said gate when arc lamp current is lower and arc lamp voltage is higher than predetermined values, therby allowing said first capacitor to repeatedly charge and discharge through said second inductor whereupon arc lamp starting voltage pulses are coupled to said first inductor.

5. The combination discharge, incandescent lamp assembly of claim 4 wherein:

said second series circuit includes an incandescable filament in series with the anode and cathode of said thyristor, and wherein said gating means alternates said pulses to said gate with a direct current to said gate, said direct current to said gate causing current to flow in series through said filament and said thyristor.

6. The lamp assembly of claim 5 wherein said gating means provides a steady direct current to said gate when arc lamp current is higher and arc lamp voltage is lower than predetermined values and no current to said gate when arc lamp current is higher and arc lamp voltage is higher than predetermined values.

7. The lamp assembly of claim 4, 5, or 6 wherein:

said oscillator is a relaxation oscillator including a resistor and second capacitor in series with a first source of half wave rectified voltage; a two terminal diac having a first terminal coupled to the junction of said resistor and said second capacitor and coupled to a second source of half wave rectified voltage alternating with the voltage of the first source of half wave rectified voltage, said diac having a second terminal coupled to the gate of said thyristor; and means to shunt said first terminal in response to arc lamp current higher than a predetermined value.

* * * * *